US005988542A

United States Patent [19]

Henreckson et al.

[11] Patent Number: 5,988,542

[45] Date of Patent: Nov. 23, 1999

[54] DOCUMENT SHREDDING DEVICES

[75] Inventors: Todd Henreckson, Gurnee; Nicholas M. Nanos, Morton Grove; Gregory Holderfield, Chicago, all of Ill.

[73] Assignee: General Binding Corporation, Northbrook, Ill.

[21] Appl. No.: 09/080,471

[22] Filed: May 18, 1998

[51] Int. Cl.[6] ..... B02C 19/12

[52] U.S. Cl. ..... 241/100; 241/236

[58] Field of Search ..... 241/100, 236, 241/285.2

[56] References Cited

U.S. PATENT DOCUMENTS

| | | | |
|---|---|---|---|
| D. 298,435 | 11/1988 | Buteau . | |
| D. 327,904 | 7/1992 | Silver et al. . | |
| D. 370,689 | 6/1996 | Harris . | |
| D. 375,973 | 11/1996 | Kennedy et al. . | |
| D. 388,819 | 1/1998 | Huen . | |
| 920,747 | 5/1909 | Hughes . | |
| 1,857,617 | 5/1932 | Berdon . | |
| 2,101,700 | 12/1937 | Chesnut, Jr. . | |
| 3,286,574 | 11/1966 | Durand | 241/236 X |
| 3,620,461 | 11/1971 | Pelleschi et al. | 241/100 |
| 3,724,766 | 4/1973 | Bosland | 241/100 |
| 4,489,897 | 12/1984 | Turner et al. . | |
| 4,637,560 | 1/1987 | Goldhammer . | |
| 4,828,188 | 5/1989 | Snyder | 241/100 X |
| 4,846,076 | 7/1989 | Menges, Sr. et al. . | |
| 4,869,435 | 9/1989 | Pistorius et al. | 241/100 |
| 4,973,004 | 11/1990 | Krause et al. | 241/100 |
| 5,054,695 | 10/1991 | Koornhorf | 241/30 |
| 5,071,080 | 12/1991 | Herbst et al. | 241/236 X |
| 5,211,294 | 5/1993 | Garman . | |
| 5,230,477 | 7/1993 | Strohmeyer | 241/236 X |
| 5,295,633 | 3/1994 | Kimbro et al. . | |
| 5,538,194 | 7/1996 | Stangenberg et al. | 241/236 X |

OTHER PUBLICATIONS

Miller's Office Products catalog, pp. 894, 895, dated Dec. 1997.

*Primary Examiner*—David A. Scherbel
*Assistant Examiner*—Anthony Ojini
*Attorney, Agent, or Firm*—Hill & Simpson

[57] ABSTRACT

The present invention provides document shredding devices mountable on various waste receptacles for shredding paper. The document shredding devices have a housing defining a paper shredding passageway. A paper shredding mechanism is contained within the housing and extends into the paper shredding passageway. A mounting support adjustably extends from a waste receptacle mounting side of the housing while remaining housing sides are free of waste receptacle mounting supports. The mounting support has a position retracted into the housing which defines a substantially linear mounting channel and another position extended outward from the housing which defines a nonlinear mounting channel.

16 Claims, 4 Drawing Sheets

DOCUMENT SHREDDING DEVICES

FIELD OF THE INVENTION

The present invention general relates to document shredding devices and more specifically, the present invention relates to new document shredding devices having an adjustable mounting support for mounting on various waste receptacles.

BACKGROUND OF THE INVENTION

Document shredding devices of the present invention can be placed on a wall of a bin or a waste receptacle, such that the document shredding devices hang on the wall over a waste collection area inside the waste receptacle. Shredded pieces of documents exiting the document shredding devices fall into the waste receptacle for collection. Existing document shredders are described in U.S. Pat. Nos. 3,724,766; 4,973,004; D375,973; and pending application Ser. No. 08/720,579 filed Oct. 2, 1996.

The mechanism for shredding documents, such as sheets of paper, fed into the shredders can be derived from the above cited utility patents, and also from U.S. Pat. No. 4,489,897.

Some small personal shredders are sold without shredder baskets and must rely on waste paper baskets normally found in the office or in the home. These waste paper baskets come in all shapes and sizes. In European countries waste paper baskets are typically round; while, in the United States many waste paper baskets are square or rectangular in shape.

U.S. Pat. No. 3,724,766 describes a shredder having oppositely arranged retaining and supporting portions which can be adjusted in length to accommodate different size waste paper baskets. The supporting portions have generally square cut, straight channels for receiving edges of the waste paper basket. U.S. Pat. No. 4,973,004 describes a paper shredder that is supportable on a waste receptacle and includes a clamping device to grip one edge of the waste receptacle. A generally rectangular cut groove is provided for this purpose. U.S. Design Pat. No. D375,973 also describes in its figures a generally straight channel for receiving edges of a waste receptacle.

U.S. patent application Ser. No. 08/720,579 discloses a housing including a support arm arrangement for a basket mounted paper shredder wherein the support arms have curved or rounded outside perimeters and at least one of the support arms has a curved or rounded inside support rib arrangement to more closely conform to a rounded waste paper basket. The support arms extend out of opposite sides of the housing, and allows the paper shredder to be mounted to both round and rectangular waste paper baskets.

In view of the existing paper shredders, it would be an advantage to have a new paper shredder which can be mounted on different waste receptacles, such as square, rectangular and round shaped waste baskets. A further advantage would be to provide such paper shredders with a mounting support which extends from only one side of the paper shredder and supports the shredder on the waste receptacle. Another advantage would be to provide new paper shredders having incrementally adjustable supports which extend from the shredder housings and are adjustable in incremental steps.

SUMMARY OF THE INVENTION

The present invention provides new document shredding devices for shredding paper documents. The new document shredding devices are mountable on various types of waste receptacles, including square, rectangular and round shaped waste paper baskets. Such waste paper baskets can be found in the office or in the home, for example, and from time to time may be changed from a basket having a particular shape to another basket having another particular shape. Accordingly, it is an advantage of the present invention to provide document shredding devices which can be mounted on various types of waste receptacles having various shapes. Also, it is an advantage of the present invention to be able to securely mount the document shredding devices on a waste receptacle having a particular shape, dismounting the document shredding devices and then mounting the document shredding devices on another waste receptacle having a different shape.

One document shredding device according to the present invention which is mountable on a waste receptacle has a housing, a paper shredding mechanism and a mounting support. The housing defines a paper shredding passageway and has a waste receptacle mounting side. The paper shredding mechanism is contained within the housing and extends into the paper shredding passageway. The mounting support adjustably extends from the waste receptacle mounting side of the housing while remaining housing sides are free of waste receptacle mounting supports. The mounting support has a position retracted into the housing which defines a substantially linear mounting channel and another position extending outward from the housing which defines a non-linear mounting channel. Preferably, the mounting support adjustably extends from the waste receptacle side of the housing in incremental steps. The mounting support may include a pair of spaced apart arms extending from the waste receptacle side of the housing and a bridge which connects the pair of arms together. The arms may be generally L shaped having a first leg extending from the waste receptacle side of the housing and a second leg extending downward from the first leg. The second legs of the pair of arms are spaced apart from each other and define a portion of the non-linear mounting channel when extended outward from the housing. The second legs of the pair of arms are also spaced away from the waste receptacle mounting side of the housing when in the retracted position and define the substantially linear mounted channel.

One document shredding device according to the present invention has a paper inlet opening for the paper shredding passageway which is sized such that an 8½" by 11" paper must be folded to fit into the inlet opening. For example, the inlet opening may have a length of less than 5".

The mounting support may adjustably extend into and out of the housing in incremental steps. Incremental adjustments of the mounting support provide for a more securely mounted shredder on the waste receptacle. The positive lock incremental steps inhibits the mounting support from retracting into or extending out of the housing when such extension or retraction is not desired, for example during use.

The present invention also provides new methods of mounting document shredders onto waste receptacles. One new method of mounting a document shredder onto a waste receptacle according to the present invention includes providing a document shredder having an adjustable mounting support extending from one side of the document shredder, adjusting the mounting support to define a desire mounting channel, placing the document shredder on a side of the waste receptacle with the mounting channel receiving the side of the waste receptacle, and supporting the document shredder on the side of the waste receptacle without additional supports. The step of adjusting the mounting support to define a desired mounting channel may include the step of incrementally adjusting the mounting support. The step of adjusting the mounting support to define a desire mounting channel may also include the step of defining one of a substantially linear mounting channel and a non-linear mounting channel. The step of placing the document shredder on a side of the waste receptacle may include the step of placing the mounting channel on either a substantially linear side of the waste receptacle or a non-linear side of another waste receptacle.

Document shredding devices of the present invention are designed to fit on a variety of waste paper baskets because of the adjustable support arms. The adjustable support arms of the document shredding device can be extended or retracted in incremental steps to fit different size waste baskets, including square, rectangular and round shaped baskets. With the adjustable support arm retracted, the document shredding device will accept any size square or rectangular waste basket greater then its length in the substantially linear mounting channel. With the adjustable support arm fully extended the document shredding device defines the smallest round shaped waste basket opening it will accept in a rounded, nonlinear mounting channel. Placing the support arm at adjustment positions between retracted and extended positions defines substantially linear mounting channels of various widths and non-linear mounting channels of various widths and non-linear shapes, such as arcuate shapes having various radii. Document shredding devices of the present invention may also be mounted on two sides of a waste receptacle which form a corner of the receptacle.

The document shredding devices of the present invention have a relatively small size and are compact units. The compact size of the document shredding devices permits the devices to be used on smaller waste receptacles, reduces their manufacturing costs and increases the portability of the devices. Accordingly, standard sizes of letter paper, including 8½" by 11" and A4 paper, need to be folded or torn prior to shredding by the document shredding devices. Smaller sized paper may not need to be folded for shredding.

The new document shredding devices provide convenient and cost effective ways of making and using paper shredders. The new document shredding devices can be mounted on a variety of types of waste receptacles having a variety of sizes and shapes.

Therefore, an advantage of the present invention is to provide new document shredding devices mountable on waste receptacles.

Another advantage of the present invention is to provide document shredding devices which can be securely mounted on linear and non-linear sides of waste receptacle.

Another advantage of the present invention is to provide document shredding devices having a mounting support adjustably extending from one side of a housing in incremental steps.

Another advantage of the present invention is to provide document shredding devices which have a mounting support extending from only one side of a housing while remaining sides of the housing are free of mounting supports.

Another advantage of the present invention is to provide document shredding devices having compact sizes.

Another advantage of the present invention is to provide new methods of mounting document shredders onto waste receptacles.

Other objects and advantages of the present invention will become apparent upon reading this disclosure including the appended claims with reference to the accompanying drawings.

DETAILED DESCRIPTION OF PRESENTLY PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

Figure 1:
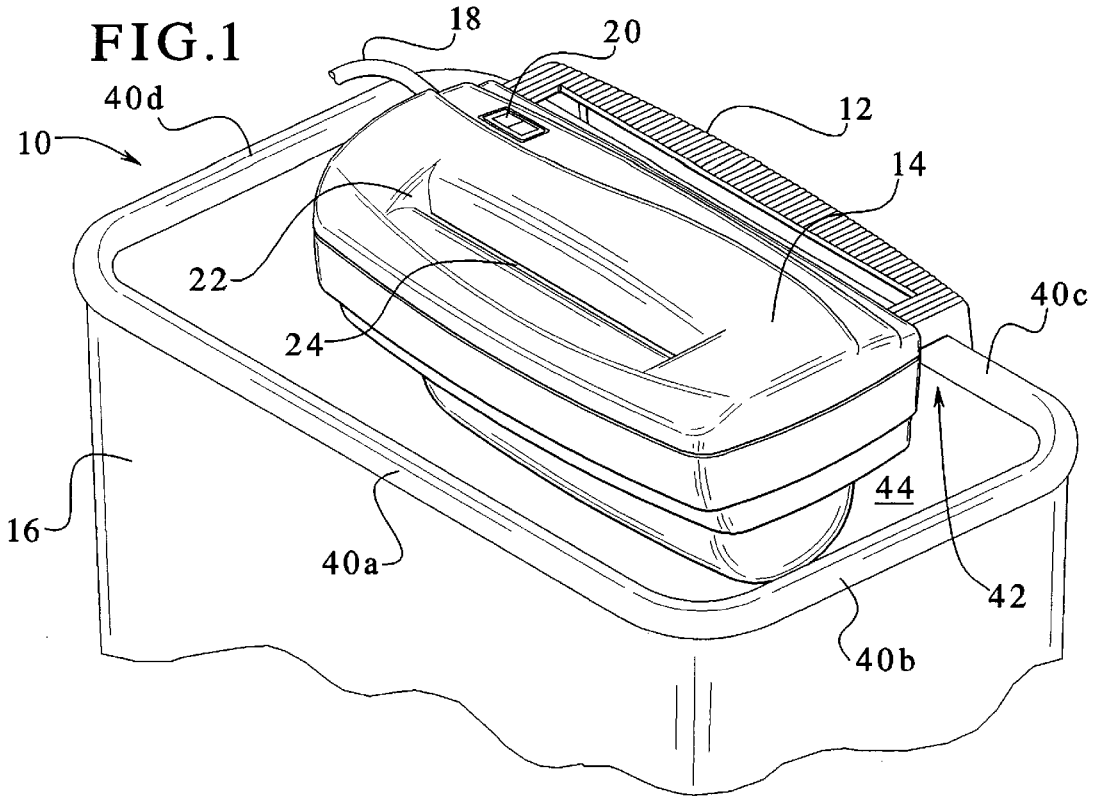
FIG. 1 is a perspective view of a document shredding device according to the principles of the present invention shown mounted on a rectangular shaped waste receptacle.

A new document shredding device 10 according to the principles of the present invention is shown by way of example in FIG. 1. The document shredding device 10 has a mounting support arm 12 extending from a housing 14 which mounts the document shredding device 10 to a waste receptacle 16. An electrical cord 18 having a plug (not shown), which can be plugged into an electrical outlet, provides electrical power to the document shredding device 10. An activation switch 20 is provided to turn the document shredding device 10 on and off. The housing 14 defines a paper inlet opening 22 to a paper shredding passageway 24 extending through the document shredding device 10.

The paper inlet opening 22 and the paper shredding passageway 24 have relatively small sizes due to the overall compact size of the document shredding device 10. For example, one document shredding device 10 may have a paper inlet opening 22 and paper shredding passageway 24 which have a size of approximately 5" or less.

Figure 8:
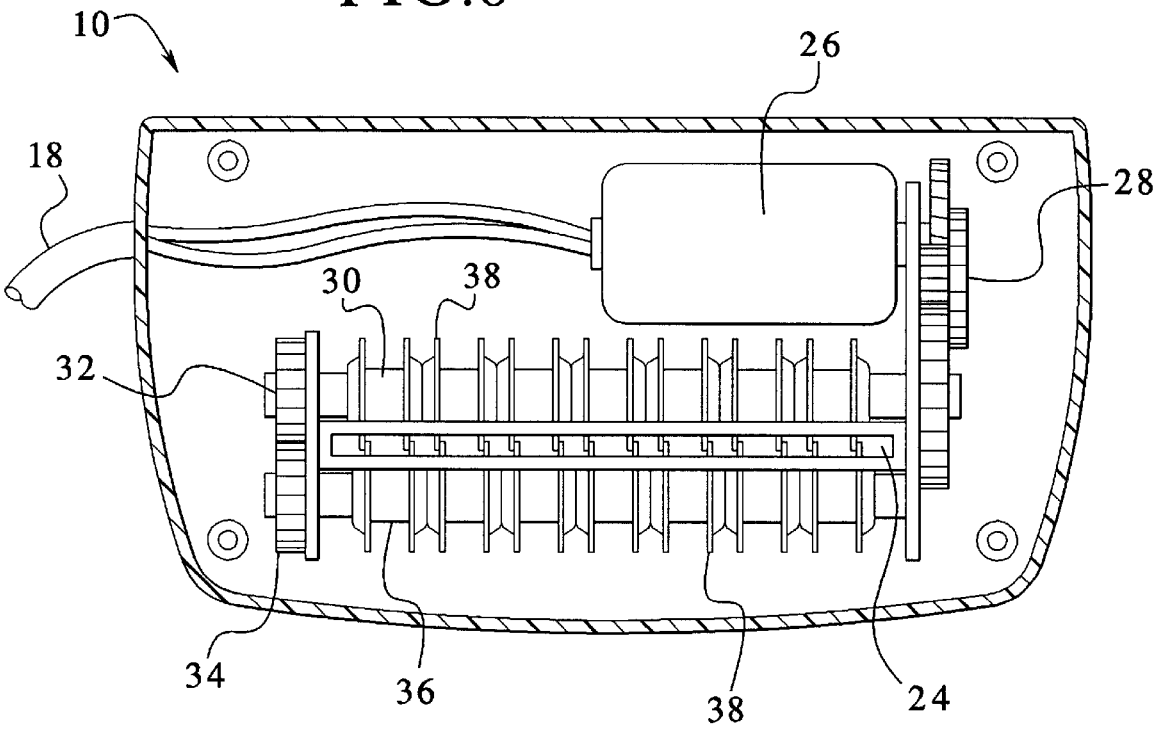
FIG. 8 is a top cross-sectional view of the document shredding device of FIG. 1.

Referring to FIG. 8, an internal shredding mechanism of the document shredding device 10 is shown. The electrical cord 18 is connected to a motor 26 which drives a gear assembly 28. The gear assembly 28 drives a first shredding roller 30 which has a gear 32 engaged with a gear 34 of a second shredding roller 36. Both of the first and second shredding rollers 30, 36 have a plurality of shredding disks 38 which extend into the paper shredding passageway 24. The shredding disks 38 have a plurality of teeth on their peripheral edges which cut the paper being shred by the document shredding device 10.

Referring to FIG. 1, the document shredding device 10 is shown mounted on the waste receptacle 16 which has a rectangular shape. Waste receptacle 16 has four upper edges 40*a*, 40*b*, 40*c*, 40*d* which are substantially linear.

Accordingly, the mounting support arm 12 forms a substantially linear mounting channel 42 for receiving the upper edge 40*c* of the waste receptacle 16. As the document shredding device 10 hangs from the edge 40*c* of the waste receptacle 16, a backside of the housing 14 may contact an inside wall 44 of the waste receptacle 16 under the edge 40*c*.

Figure 2:
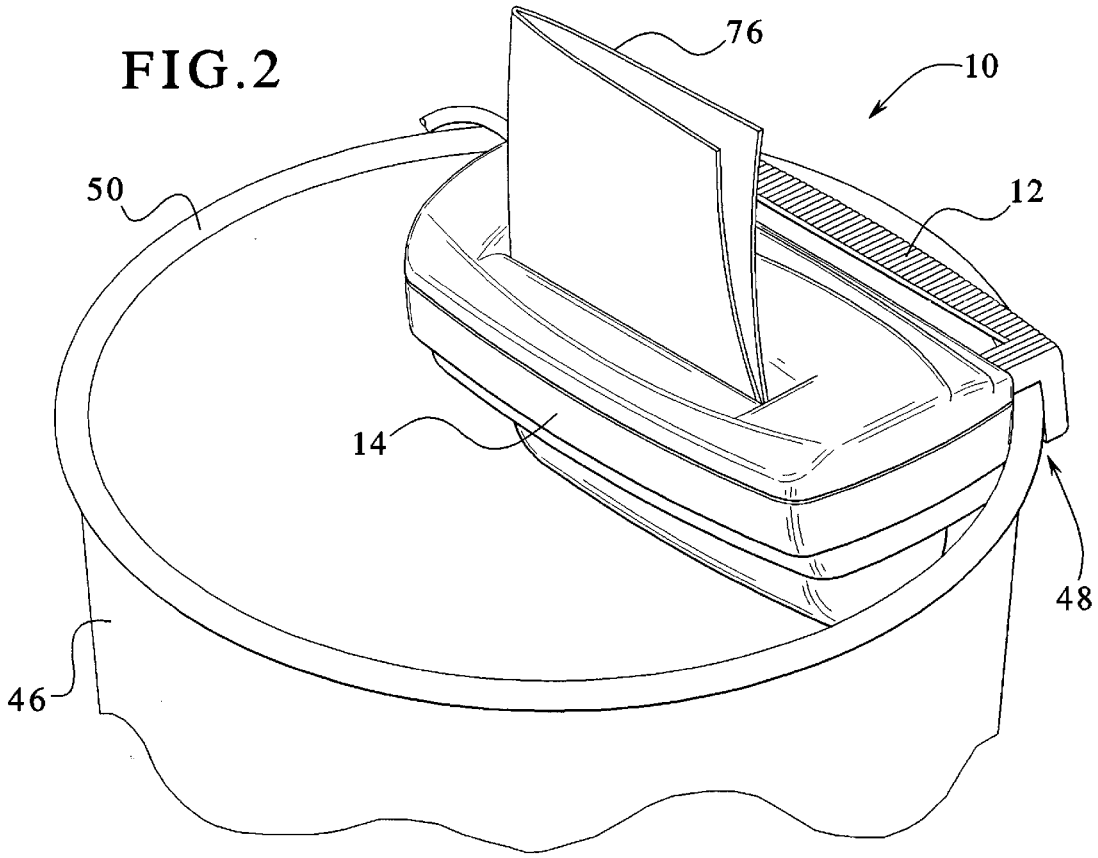
FIG. 2 is a perspective view of the document shredding device of FIG. 1 mounted on a round waste receptacle.

FIG. 2 shows the document shredding device 10 mounted onto a non-linear, round shaped waste receptacle 46. The mounting support arm 12 is adjusted into or out of the housing 14 to form a desired non-linear mounting channel 48. A non-linear mounting channel 48 receives an upper edge 50 of the round waste receptacle 46 to support the document shredding device 10 on the waste receptacle 46.

Figure 3:
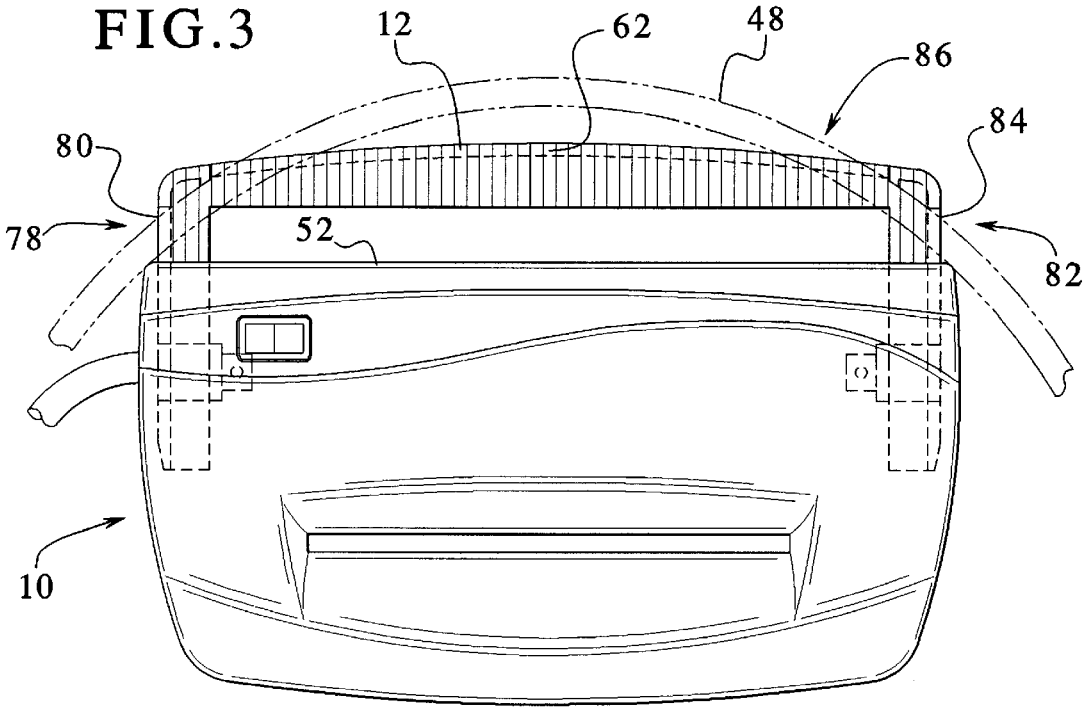
FIG. 3 is a top plan view of the document shredding device of FIG. 1.
Figure 4:
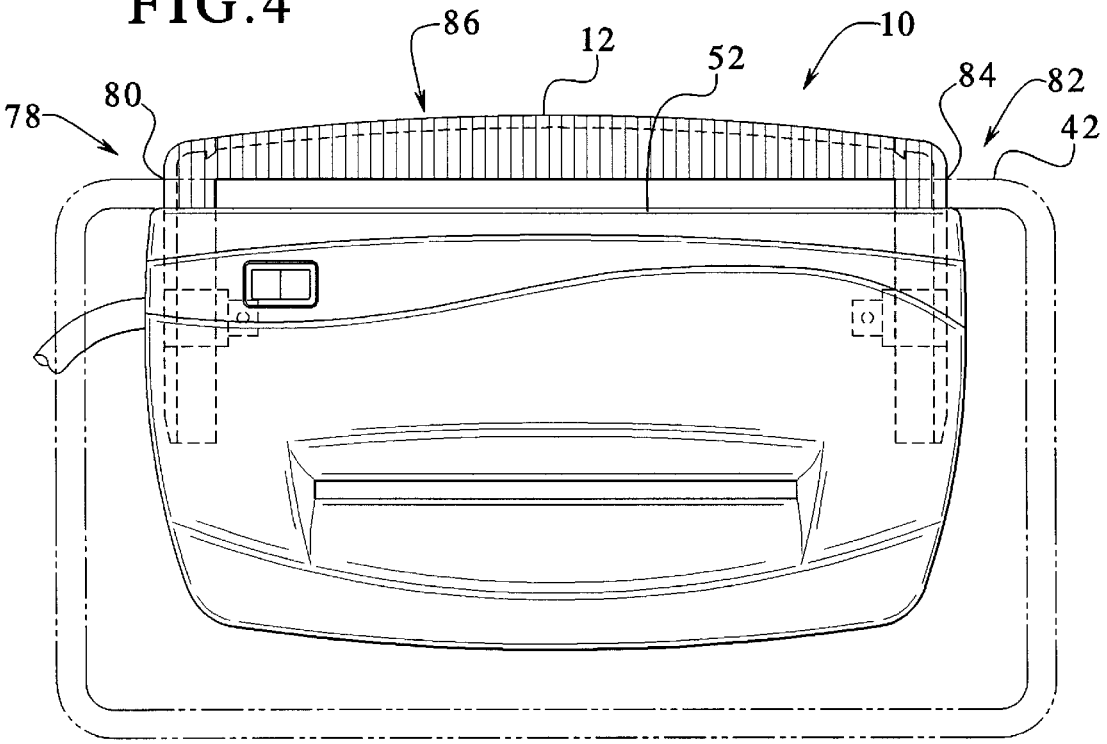
FIG. 4 is another top plan view of the document shredding device of FIG. 1.

FIGS. 3 and 4 show the non-linear mounting channel 48 and the substantially linear mounting channel 42 more clearly. The non-linear mounting channel 48 extends through left and right sides and a backside of the mounting support arm 12. The substantially linear mounting channel 42 extends through the left and right sides of the mounting support arm 12 along a backside of the housing 14.

Figure 5:
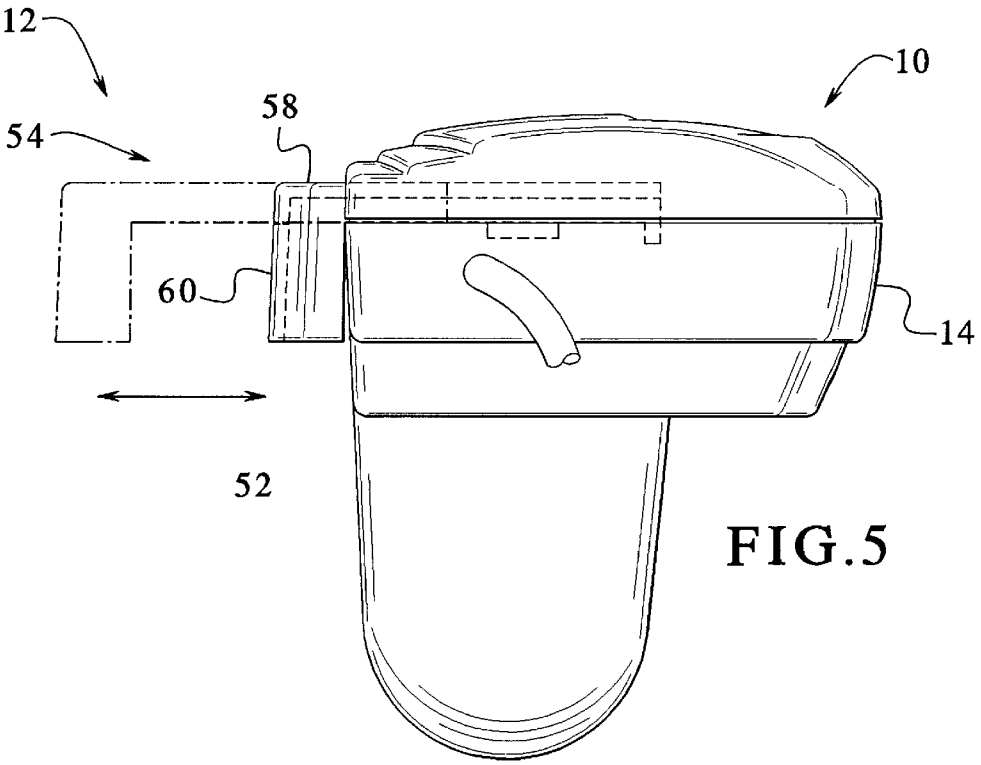
FIG. 5 is a side elevational view of the document shredding device of FIG. 1.

Referring to FIG. 5, a side view of the document shredding device 10 shows the adjustment of the mounting support arm 12. The mounting support arm 12 extends from a waste receptacle mounting side or backside 52 of the housing 14. The mounting support arm 12 is adjustable between a fully retracted position next to the waste receptacle mounting side 52 and a fully extended position spaced at a maximum distance from the waste receptacle mounting side 52 (shown in phantom). When the mounting support arm 12 is in the fully retracted position, the document shredding device 10 may not be mountable on a waste receptacle. This position of the mounting support arm 12 may be useful for storage or transporting the document shredding device 10. The mounting support arm 12 is adjustable between its fully retracted and fully extended positions. As the mounting support arm 12 is extended out of the waste receptacle mounting side 52 of the housing 14, the substantially linear mounting channel 42 and the non-linear mounting channel 48 become available for mounting the document shredding device 10 to the waste receptacle.

Figure 6:
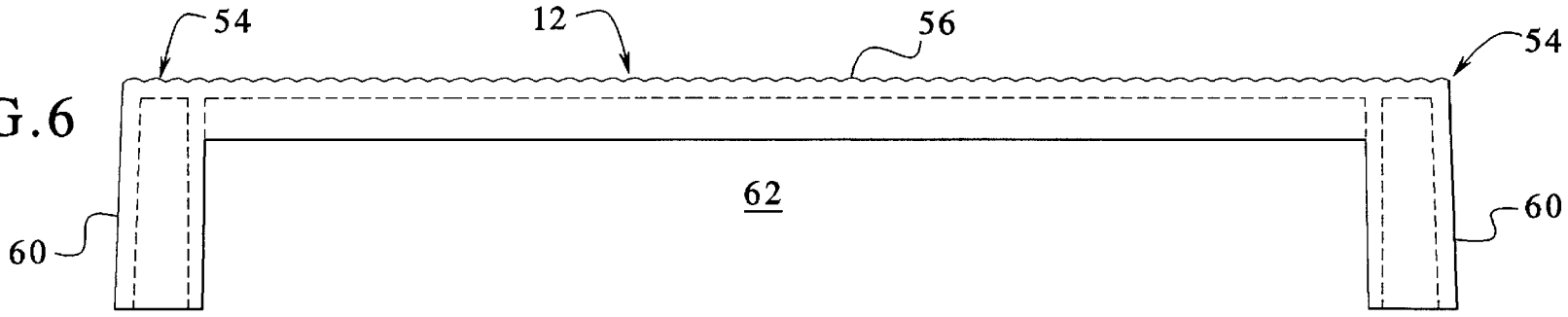
FIG. 6 is a rear view of a mounting support of the document shredding device of FIG. 1.
Figure 7:
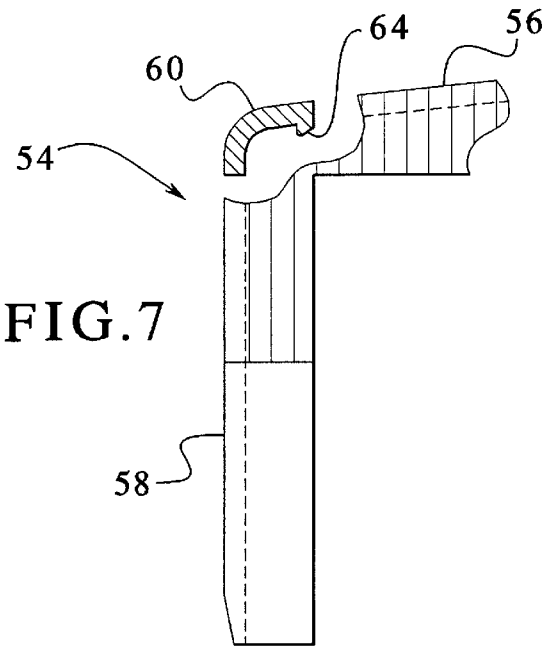
FIG. 7 is a top view of a portion of the mounting support of FIG. 6 showing a portion of the mounting support in cross section.

Referring to FIGS. 5–7, the mounting support arm 12 will be further described. The mounting support arm 12 has a pair of generally L shaped arms 54 which are spaced apart from each other and extend from the waste receptacle mounting side 52 of the housing 14. A bridge 56 connects the two spaced apart, L shaped arms 54. Each of the L shaped arms 54 has a first leg 58 extending horizontally and adjustably from the waste receptacle mounting side 52 of the housing side 14. A second leg 60 extends downward from the first leg 58 to form the L shaped arm 54.

The substantially linear mounting channel 42 is formed by pulling the mounting support arm 12 outward from the waste receptacle mounting side 52 of the housing 14. The spaced apart L shaped arm 54, specifically the first and second legs 58, 60, form the substantially linear mounting channel 42 along the waste receptacle mounting side 52. The non-linear mounting channel 48 is formed by the spaces created between the L shaped arms 54 and the waste receptacle mounting side 52 when the mounting support arm 12 is pulled outward from the document shredding device 10. The non-linear mounting channel 48 is also formed by an opening 62 below the bridge 56 and between the L shaped arms 54, as can be seen in FIGS. 6 and 3. Referring to FIG. 7, a beveled or rounded corner may be provided on the second leg 60 of the L shaped arm 54 to further define the non-linear mounting channel 48, as can also be seen in FIG. 3.

Referring to FIGS. 3 and 4, the mounting support arm 12 has a first side 78 which defines a first opening 80, a second side 82 opposite the first side 78 which defines a second opening 84, and a backside 86 defining a backside opening 62. The backside opening 62 is also shown in FIG. 6. Referring to FIG. 4, the substantially linear mounting channel 42 projects through the first and second openings 80, 82. Referring to FIG. 3, the non-linear mounting channel 48 projects through the first, second and backside openings 80, 82 and 62.

Figure 9:
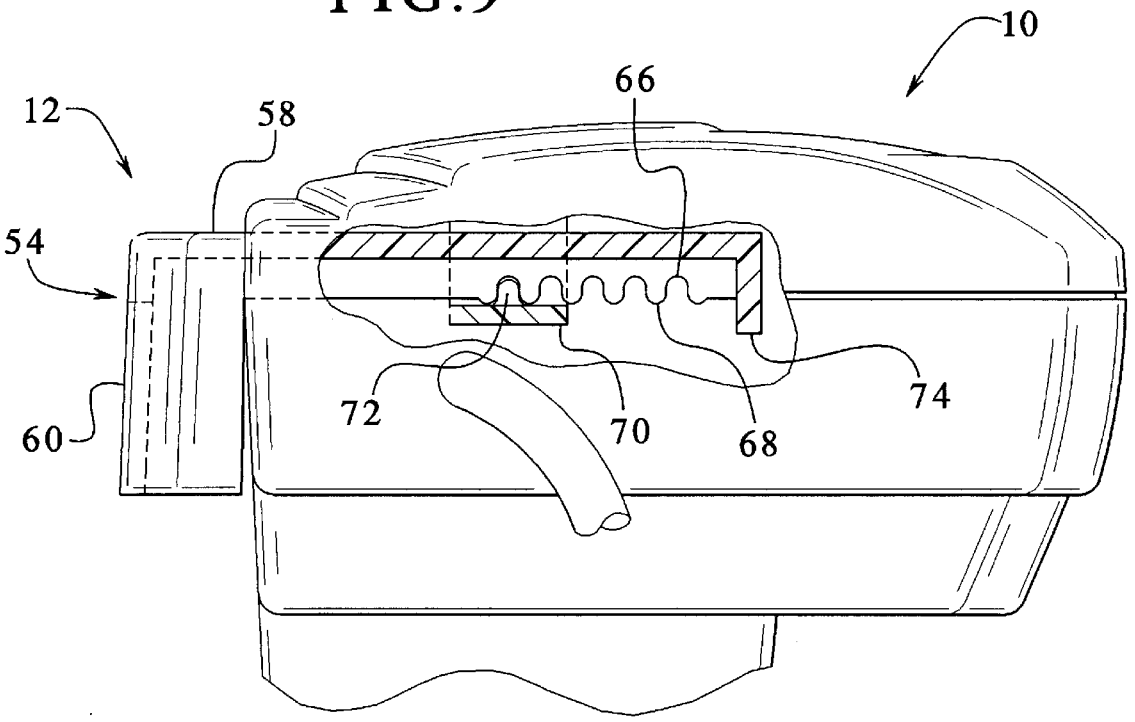
FIG. 9 is a side elevational view of the document shredding device of FIG. 1 with a portion of a housing broken away.

Referring to FIG. 9, the incremental adjustability of the mounting support arm 12 as shown. The first leg 58 of the L shaped arm 54 has a plurality of alternating recesses 66 and projections 68. An incremental adjustment member 70 is attached to the housing 14 and has a corresponding projection 72. The projections 68 and 72 are sufficiently flexible to permit the projection 72 on the incremental adjustment member 70 to pass from one recess 66 to another recess 66 on the first leg 58. In this manner, the mounting support arm 12 is adjustable into and out of the housing 14 in incremental steps having positive stops. An end stop 74 may be provided on the first leg 58 which abuts the incremental adjustment member 70 when the mounting support arm 12 is fully extended and prevents removal of the mounting support arm 12 from the housing 14.

Although the non-linear mounting channel 48 is shown as being mounted on a round waste receptacle 46 in FIG. 2, the document shredding device 10 can be mounted on non-linear waste receptacles other than round receptacles. For example, the non-linear mounting channel 48 of the document shredding device 10 can be used to mount the device on oval shaped waste receptacles. The non-linear mounting channel 48 can also be used to mount the document shredding device 10 on a comer of the square or rectangular shaped waste receptacles. For example, the document shredding device 10 could be mounted on edges 40*b* and 40*c* of the waste receptacle 16 shown in FIG. 1. The corner of the waste receptacle 16 formed by the edges 40*b* and 40*a* would extend out through the opening 62 in the mounting support arm 12.

Operation of the document shredding device 10 will now be described. The mounting support arm 12 is adjustably extended out of or into the waste receptacle mounting side 52 of the housing 14 to define the desired substantially linear mounting channel 42 or non-linear mounting channel 48. The document shredding device 10 is placed on the desired waste receptacle such that the mounting channel receives an edge of the waste receptacle and the paper shredding passageway 24 overhangs the waste receptacle. The electrical cord 18 is connected to a power source and the activation switch 20 is moved to the forward on position. A document 76 (FIG. 2) is inserted into the paper inlet opening 22 of the paper shredding passageway 24. The document shredding device 10 shreds the paper 76 and the shredded paper is deposited into the waste receptacle. As shown in FIG. 2, the paper 76 may need to be folded one or more times to fit into the paper inlet opening 22. If the paper 76 becomes jammed in the document shredding device 10, the activation switch 20 can be moved to a reverse position. In the reverse position, the document shredding device 10 will tend to clear the paper 76 out of the shredding mechanism.

While the presently preferred embodiments have been illustrated and described, numerous changes and modifications can be made without significantly departing from the spirit and scope of this invention. Therefore, the inventors intend that such changes and modification are covered by the appended claims.

We claim as our invention:

1. A document shredding device mountable on a waste receptacle comprising:

a housing defining a paper shredding passageway and having a waste receptacle mounting side;

a paper shredding mechanism within the housing and extending into the paper shredding passageway; and a mounting support adjustably extending from the waste receptacle mounting side of the housing while remaining housing sides are free of waste receptacle mounting supports, the mounting support having a first position which defines a substantially linear mounting channel and another position which defines a non-linear mounting channel;

the mounting support having a first side defining a first opening, a second side apposite the first side and defining a second, and a backside defining a backside opening, the substantially linear mounting channel projecting through the first and second openings, and the non-linear mounting channel projecting through the first, second and backside openings.

2. The document shredding device of claim 1 wherein the mounting support adjustably extends from the waste receptacle side of the housing in incremental adjustments.

3. The document shredding device of claim 1 wherein the mounting support extends along a relatively long side of the housing.

4. The document shredding device of claim 1 wherein the mounting support comprises:

a pair of spaced apart arms extending from the waste receptacle side of the housing; and a bridge connected to the pair of arms.

5. The document shredding device of claim 4 wherein each arm is generally L shaped having a first leg extending from the waste receptacle side of the housing and a second leg extending downward from the first leg, the second legs of the pair of arms being spaced apart from each other and defining a portion of the non-linear mounting channel.

6. The document shredding device of claim 5 wherein the second leg has beveled edge defining a portion of the non-linear mounting channel.

7. The document shredding device of claim 4 wherein each arm is generally L shaped having a first leg extending from the waste receptacle side of the housing and a second leg extending downward from the first leg, the second legs of the pair of arms being spaced away from the waste receptacle mounting side of the housing when in the retracted position and defining the substantially linear mounting channel.

8. The document shredding device of claim 1 wherein the paper shredding passageway has a paper inlet opening sized such that an 8½" by 11" paper must be folded to fit in the inlet opening.

9. The paper shredding device of claim 8 wherein the inlet opening has a length of less than 5".

10. The document shredding device of claim 1 further comprising:

at least one first incremental adjustment member connected to one of the housing and the mounting support; and at least one second incremental adjustment member connected to the other of the housing and the mounting support;

wherein the first and second incremental adjustment members are engaged with each other such that the mounting support is incrementally adjustable relative to the housing.

11. The document shredding device of claim 1 wherein the substantially linear mounting channel is adapted to mountingly receive a substantially straight side of the waste receptacle, and wherein the non-linear mounting channel is adapted to mountingly receive an arcuate side of the waste receptacle.

12. A document shredding device removably and alternatively mountable on a first waste receptacle having a substantially linear mounting edge and a second waste receptacle having a non-linear mounting edge, the document shredding device comprising:

housing defining a paper shredding passageway and having a waste receptacle mounting side;

a paper shredding mechanism within the housing and extending into the paper shredding passageway;

a mounting support adjustably extending from the waste receptacle mounting side of the housing in incremental adjustments while remaining housing sides are free of waste receptacle mounting supports, the mounting support having a position retracted into the housing which defines a substantially linear mounting channel and another position extended outward from the housing which defines a non-linear mounting channel;

the mounting support having a first side defining a first opening, a second side opposite the first side and defining a second opening and a backside defining a backside opening, the substantially linear mounting channel projecting through the first and second openings, and the non-linear mounting channel projecting through the first, second and backside opening;

at least one first incremental adjustment member connected to one of the housing and the mounting support; and at least one second incremental adjustment member connected to the other of the housing and the mounting support;

wherein the first and second incremental adjustment members are engaged with each other such that the mounting support is incrementally adjustable relative to the housing.

13. The document shredding device of claim 12 wherein the mounting support comprises:

a pair of spaced apart arms extending from the waste receptacle side of the housing; and a bridge connected to the pair of arms.

14. The document shredding device of claim 13 wherein each arm is generally L shaped having a first leg extending from the waste receptacle side of the housing and a second leg extending downward from the first leg, the second legs of the pair of arms being spaced away from the waste receptacle mounting side of the housing when in the retracted position and defining the substantially linear mounting channel, the second legs of the pair of arms being spaced apart from each other and defining a portion of the non-linear mounting channel.

15. The document shredding device of claim 14 wherein the paper shredding passageway has a paper inlet opening sized such that an 8½" by 11" paper must be folded to fit in the inlet opening.

16. The document shredding device of claim 15 wherein the inlet opening has a length of less than 5".

* * * * *